United States Patent [19]

College et al.

[11] 4,346,934

[45] Aug. 31, 1982

[54] EXCAVATING BIT

[75] Inventors: Michael A. College, Everett; Robert J. McKenry, Windber, both of Pa.

[73] Assignee: Kennametal Inc., Latrobe, Pa.

[21] Appl. No.: 9,710

[22] Filed: Feb. 5, 1979

Related U.S. Application Data

[63] Continuation of Ser. No. 811,181, Jun. 29, 1977, abandoned.

[51] Int. Cl.[3] ..... E21C 35/18

[52] U.S. Cl. ..... 299/92; 175/354

[58] Field of Search ..... 299/86, 91, 92, 93, 299/79; 175/354

[56] References Cited

U.S. PATENT DOCUMENTS 2,434,256 1/1948 Bowmann ..... 299/93 X
2,907,559 10/1959 Brown et al. ..... 299/92
3,767,266 10/1973 Krekeler ..... 299/86
3,841,709 10/1974 Kniff ..... 175/413

FOREIGN PATENT DOCUMENTS 1101085 1/1968 United Kingdom ..... 299/92

*Primary Examiner*—William F. Pate, III
*Attorney, Agent, or Firm*—Lawrence R. Burns

[57] ABSTRACT

A nonrotatable excavating bit comprising a forward working portion and hard wear resistant material attached thereto and having a rearward shank portion which is circular in cross section and is adapted to fit into a circular bore of a support block. An abutment shoulder is formed at the juncture of the forward working portion and rearward shank portion and a tang extends from the shoulder and is adapted to fit down over and mate with a surface of said support block so as to hold the bit nonrotatable in the support block.

10 Claims, 3 Drawing Figures

EXCAVATING BIT

This is a continuation of application Ser. No. 811,181, filed June 29, 1977 now abandoned.

BACKGROUND OF THE INVENTION

The present invention has to do with excavating bits which are mounted on tool holders on rotating drums and are used to reduce concrete, asphalt and like formations.

A popular bit which is used on such rotating drums is the rotatable, conical point bit that is more fully described in U.S. Pat. No. 3,519,309, granted to Engle et al and assigned to Kennametal Inc. The Engle et al type bit is usually mounted in the support block which is welded to a rotatable drum and is mounted in such a way that the bit is rotatable within its own support block.

These bits, when mounted on drums, are useful in reducing or planing concrete formations. However, when other formations, such as asphalt, are planed, it is frequently necessary to resort to a bit which has a flat, forwardly facing working portion. When such a bit with a flat, forwardly facing working portion is used, it must be held nonrotatably within its support block in order to perform properly.

Since the drums with the support holders mounted thereon are sometimes switched from one type of work, such as concrete, to another, such as working on asphalt, it is desirable to have a bit which will be interchangeable with the rotatable bit as described by Engle et al, and yet will have a flat, forward working portion and be nonrotatable when held in the same support block.

Prior art bits which have been suggested or tried have used pins or lugs on the bits that necessitated the removal of parent material from the support block in order to engage either the lug or pin member that was used to hold the bit nonrotatably within the block.

It is an object of the present invention to provide a nonrotatable bit which is interchangeable with a support block for a rotatable bit without the weakening of the support block structure.

A further object of the present invention is to provide a nonrotatable bit which is easily and efficiently removable from a rotatable type bit support block.

BRIEF SUMMARY OF THE INVENTION

According to the present invention, a nonrotatable excavating bit is provided having a substantially flat working portion on one end and a cylindrical shank portion on the other with the shank portion adapted to be received and retained in a bore of a support block.

An abutment shoulder formed by the juncture of the shank portion with the working portion has a tang extending outwardly and downwardly from said abutment shoulder so as to mate over a face of the support block and hold the bit nonrotatable in the support block.

The cylindrical shank preferably has an undercut formed thereon for receiving a resilient spring type clip therein to mate with a corresponding groove in the bore of the support block.

The exact nature of the present invention will become more clearly apparent upon reference to the following detailed specification taken in connection with the accompanying drawings in which.

DETAILED DESCRIPTION OF THE INVENTION

Figure 1:
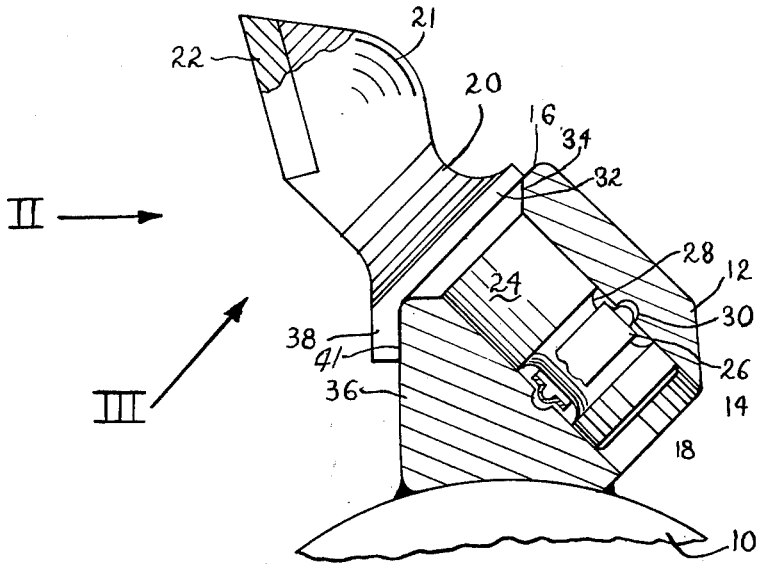
FIG. 1 is a partially broken away side view of the bit and block according to the present invention.

Referring to the drawings somewhat more in detail, what is shown in FIG. 1 is rotatable drum 10 upon which is welded a support block 12. Support block 12 has a bore 14 which is cylindrical in cross section and extends from a front face 16 completely through the block through a rearward face 18.

Mounted in support block 12 is a nonrotatable excavating bit 20 which has a forward working portion 21 having a flat portion 22 which is preferably comprised of a hard wear resistant material such as a cemented hard metal carbide.

Nonrotatable bit 20 has a rearward shank portion 24 which is cylindrical in cross section and is adapted to interfit with the bore 14 and be held in support block 12 by spring clip 26. Spring clip 26 engages the undercut 28 with the nonrotatable bit with a groove 30 which is formed in the wall of the cylindrical bore 14 of support block 12.

A rearwardly facing abutment shoulder 32 is formed on the bit at the juncture of the shank 24 of forward working portion 21 such that, preferably, cooperating elements of abutment means between the block 12 and the bit 20 are formed as is shown at 34. Support block 12 has angularly related faces such as is shown at 36 which are adjacent to the forward face 16 of block 12. Tang element 38 extends from the abutment shoulder 32 downwardly over face 36 such that only face 41 of tang element 38 which faces shank portion 24 mates with the smooth exterior support block face 36. Face 36 is angularly related to the axis of the bore 14 such that when the tang face 41 is mated against it, the bit 20 is held nonrotatable within the block 12.

Figure 2:
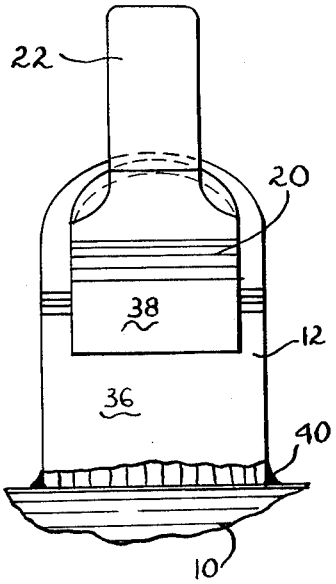
FIG. 2 is a view through II—II of FIG. 1.

Further in FIG. 2, a rotatable drum 10 is shown with the block 12 having weldment 40 joining the drum and the block. Nonrotatable bit 20 is shown having the flat, hard wear resistant working portion 22 and tang element 38 extending down over face 36 of support block 12. It should be noted that the width of the tang 38 of nonrotatable bit 20 is preferably wider than the width of the working portion 22 so as to have sufficient strength so as to resist the tendency of bit 20 to rotate.

Figure 3:
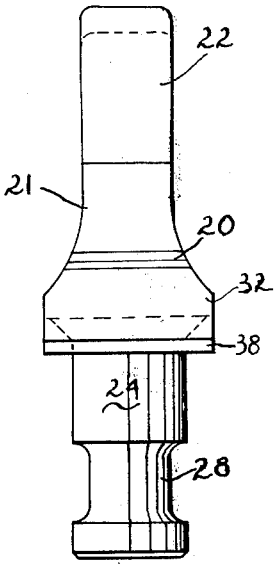
FIG. 3 is a view through III—III of FIG. 1.

Shown in FIG. 3, again, is the nonrotatable bit 20 having flat, forward working face 22 mounted on the forward working portion 21. Cylindrical shank portion 24 is shown having undercut 28 preferably to accommodate the spring clip 26. Tang portion 38 is shown which extends below the shoulder 32 which is formed at the juncture of the cylindrical shank 24 and forward working portion 21 is nonrotatable bit 20.

Modifications may be made within the scope of the appended claims.

What is claimed is:

1. A nonrotatable excavating bit, designed for mounting in a support block having a bore in one face and a smooth exterior face which is angularly related to, but not perpendicular to, the bore axis, said bit comprising a substantially flat working portion on one end and a cylindrical shank portion on the other; said shank portion adapted to be received in said bore so as to retain said bit in the support block; an abutment shoulder formed by the juncture of said shank portion with said working portion; a tang extending from said abutment shoulder; said tang having a tang face which faces said shank portion; said tang face is angularly related to, but not perpendicular to, the shank portion axis; said tang face in and of itself sufficiently defining a means for mating with said smooth exterior face of said support block and holding said bit nonrotatable in the support block.

2. An excavating bit according to claim 1 in which said cylindrical shank has an undercut formed thereon for receiving a resilient clip therein.

3. An excavating bit according to claim 2 which further includes a resilient clip mounted in said undercut and in a free state extending beyond the confines of said undercut and the bore in the support block.

4. In combination: a support block and a bit wherein said support block has a bottom portion for attachment to an earthworking machine; a forwardly projecting face on said support block through which a bore is formed to receive said bit; said bit having a flat forwardly extending working surface and a cylindrical rearwardly extending shank adapted to be received in said bore; angularly related exterior faces surround said forwardly projecting face on said support block; cooperating means on said block and said bit for holding said bit in said block; a tang extending from said bit; said tang having a tang face which faces said shank; said tang face is angularly related to, but not perpendicular to, the bore axis; said tang face contacting one of said angularly related exterior faces of said block; and said contacting, in and of itself, sufficient to define a means for holding said bit nonrotatably in said block.

5. The combination according to claim 4 which further includes cooperating elements of abutment between said block and said bit for transmitting the working load from the bit to the block.

6. The combination according to claim 5 which includes an annular abutment face on said bit formed at the juncture of said working face of said bit and said cylindrical shank of said bit.

7. The combination according to claim 6 which further includes said tang extending from said abutment face of said bit.

8. A nonrotatable excavating bit according to claim 1 wherein said tang face facing said shank portion and which mates with a smooth exterior face of the support block is comprised of a single smooth plane.

9. A combination according to claim 7 wherein said angularly related face of said support block which contacts said tang of said bit is also angularly related to the axis of said bore.

10. A method for holding a nonrotatable bit nonrotational in a rotational bit support block comprising the steps of: sliding the shank portion of a nonrotatable bit, having a substantially flat working portion on one end and a cylindrical shank portion on the other, into the bore in one face a support block; releasably locking said shank portion in said bore; abutting the abutment shoulder formed by the juncture of said working portion with said shank portion against the forwardly projecting face on said support block through which the bore is formed; holding the bit nonrotatably in the support block based solely on mating a tang extending from said abutment shoulder with the support block such that only the face of the tang facing said shank portion is mating against one exterior major face of the support block which is angularly related to, but not perpendicular to the bore axis.

* * * * *